US007429014B2

(12) United States Patent
Burnett

(10) Patent No.: US 7,429,014 B2
(45) Date of Patent: Sep. 30, 2008

(54) PORTABLE, ATTACHABLE, AUXILIARY TOILET TISSUE ROLL HOLDER

(76) Inventor: Allen Garrett Burnett, 3184 Rock Creek Dr., Rex, GA (US) 30273-2440

( * ) Notice: Subject to any disclaimer, the term of this patent is extended or adjusted under 35 U.S.C. 154(b) by 0 days.

(21) Appl. No.: 11/595,193

(22) Filed: Nov. 9, 2006

(65) Prior Publication Data

US 2008/0111018 A1 May 15, 2008

(51) Int. Cl.
*B65H 75/02* (2006.01)

(52) U.S. Cl. ..... 242/588

(58) Field of Classification Search ..... 242/588, 242/588.3, 400, 405; 206/394
See application file for complete search history.

(56) References Cited

U.S. PATENT DOCUMENTS 3,892,310 A * 7/1975 Welin-Berger
5,104,054 A * 4/1992 Latham
6,068,118 A * 5/2000 Calloway
7,025,205 B2 * 4/2006 Barker
2003/0230500 A1 * 12/2003 McDaniel
2006/0108248 A1 * 5/2006 Power et al.
2006/0231438 A1 * 10/2006 Anderson
2007/0012814 A1 * 1/2007 Burnett

OTHER PUBLICATIONS 2006-619738, Jul. 2003, Derwent, Gmeiner.*

* cited by examiner

*Primary Examiner*—William A Rivera

(57) ABSTRACT

A portable holder containing one or more single-use size roll or rolls of tightly wound auxiliary or emergency toilet tissue. The holder is easily and adaptably attachable to other objects or devices. The holder protects the roll or rolls from ordinary damaging forces such as wear, dirt and moisture. The size of the holder and/or the design of the holder make it concealable and/or discreet.

6 Claims, 3 Drawing Sheets

PORTABLE, ATTACHABLE, AUXILIARY TOILET TISSUE ROLL HOLDER

RELATED APPLICATIONS

Applicant filed patent application Ser. No. 11/182,978 on Jul. 15, 2005 for a Toilet Tissue Roll Holder Axle With Auxiliary Tissue. The present application is similar in nature to that pending application in having a compartment for storing auxiliary toilet tissue.

Applicant filed patent application Ser. No. 11/357,571 on Feb. 17, 2006 for a Wall Mount Toilet Tissue Roll Holder With Auxiliary Tissue. The present application is similar in nature to that pending application in having a compartment for storing auxiliary toilet tissue.

Applicant filed patent application Ser. No. 11/395,037 on Mar. 31, 2006 for a Wall Mount Mechanical Toilet Tissue Roll Holder With Auxiliary Tissue. The present application is similar in nature to that pending application in having a compartment for storing auxiliary toilet tissue.

Applicant filed patent application Ser. No. 11/406,539 on Apr. 19, 2006 for a Pivoting Toilet Tissue Roll Holder With Auxiliary Tissue. The present application is similar in nature to that pending application in having a compartment for storing auxiliary toilet tissue.

Applicant filed patent application Ser. No. 11/476,449 on Jun. 28, 2006 for a Toilet Tissue Roll Holder Spindle With Auxiliary Toilet Tissue. The present application is similar in nature to that pending application in having a compartment for storing auxiliary toilet tissue.

Applicant filed patent application Ser. No. 11/477,316 on Jun. 29, 2006 for a Suspended Toilet Tissue Roll Holder With Auxiliary Toilet Tissue. The present application is similar in nature to that pending application in having a compartment for storing auxiliary toilet tissue.

FIELD OF THE INVENTION

The present invention relates to toilet tissue holders and, more particularly, to a portable, attachable holder containing auxiliary or emergency toilet tissue

BACKGROUND OF THE INVENTION

The need for individuals to have access to a clean and dry auxiliary or emergency supply of toilet tissue presents itself on occasion and without warning in every facet of modern life. Public restrooms depleted of toilet tissue. Public restrooms containing inferior toilet tissue. Public restrooms containing contaminated or soiled toilet tissue. Out of doors where no modern public restroom facilities exist; such as when hiking, camping, boating, or other recreational or sporting pursuits. Occupational situations requiring workers to temporarily be an inconvenient distance from modern public restroom facilities. Emergency or disaster situations where modern restroom facilities have been rendered inoperable or inaccessible, such as earthquake zones, flood zones, terrorism targets or any other events where individuals could use a clean and dry, portable, single-use supply of toilet tissue to adequately maintain some degree of hygiene. Any time and any place where individuals are conducting any activities and are not within a convenient distance to a well maintained, modern restroom facility could present a sudden and unexpected need for toilet tissue.

There is the need for individuals to be able to share their supply of toilet tissue without depriving themselves of toilet tissue. There is also the need for individuals to be able to share their supply of toilet tissue with more than one other individual in need at the same time. These and similar "need to share" situations arise in many of the same situations mentioned previously; such as an adult leading a group of hiking children, an emergency worker extending aid and comfort to multiple victims in a disaster zone, or a traveler assisting many others stranded on a roadway by incident or weather. There is need of a means for providing toilet tissue in these instances where an amount of toilet tissue adequate to service many individuals is in multiple small units as opposed to one large unit such as an ordinary, unprotected toilet tissue roll.

There is the need for individuals to store auxiliary or emergency toilet tissue where it might be required, while doing so by disguise to avoid embarrassment or ridicule. There is a need to protect a supply of auxiliary or emergency toilet tissue from ordinary damaging forces such as wear, dirt or moisture. There is a need to easily attach a supply of auxiliary or emergency toilet tissue to other common objects so it can be easily transported, located, and reduce the risk of it being misplaced by either activity or time passing.

Small packages of all sorts of non-toilet tissue types and holders for same can be found in great number.

Small rolls of toilet tissue, and dispensers for those rolls are produced for camping or other portable, multi-event use purposes.

The need to supply auxiliary or emergency toilet tissue in single-use amounts when standard forms of toilet tissue are depleted or are absent is long established. U.S. Pat. No. 2,801,809 filed May 6, 1954 and issued Aug. 6, 1957 to L. O. Glaner addressed the need.

U.S. Pat. No. 5,255,861 issued Oct. 26, 1993 to Saul Lerner also addressed the need.

Previous Patent Applications filed by this applicant which provide for auxiliary toilet tissue rolls do also address the need.

Portable, attachable holders for other tissue types do not provide an individual with the preferred perforated roll form of toilet tissue.

Camping and other portable-use toilet tissue products are contained in devices designed for dispensing due to their large, multi-use utility. These dispenser-type holders necessarily have openings for the dispensing action and therefore offer very little if any protection against ordinary damaging forces such as wear, dirt or moisture. Their dispensing design and inherent size do not afford these devices a discrete or easily concealable embodiment. Multi-use rolls do not provide a means for sharing a toilet tissue supply with another person without the users remaining in close proximity. Multi-use rolls do not provide a means of simultaneously sharing a toilet tissue supply with several people simultaneously.

The Glaner device design only makes it attachable to some permanently affixed toilet tissue roll holders found in modern restroom facilities.

The Lerner device design only makes it attachable to some permanently affixed toilet tissue roll holders found in modern restroom facilities.

The devices disclosed in this applicant's previous patent applications are only attachable to permanently affixed toilet tissue roll holders, or are themselves permanently affixed toilet tissue roll holders.

Embodiments of the present invention provide a means to usually, conveniently and/or discreetly maintain a clean and dry auxiliary or emergency supply of toilet tissue close at hand.

It is therefore an object of the invention to provide auxiliary or emergency toilet tissue in roll form in an amount sufficient for a single-use.

It is another object of the invention to provide a portable, protective, adaptably attachable, concealable or discreet holder containing an auxiliary or emergency toilet tissue roll.

It is another object of the invention to provide a portable, protective, adaptably attachable holder with multiple auxiliary or emergency toilet tissue rolls.

SUMMARY OF THE INVENTION

The present invention is a holder containing one or more single-use size roll or rolls of tightly wound toilet tissue for auxiliary or emergency needs when ordinary toilet tissue supplies are absent, unusable, inconvenient or embarrassing. The holder is portable. The holder is easily and adaptably attachable to other objects or devices ordinarily present when individuals participate in general or specific activities. The holder offers adequate protection to the roll or rolls from ordinary damaging forces such as wear, dirt and moisture. The size of the holder or the design of the holder make it concealable or discreet.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF A PREFERRED EMBODIMENT

Figure 1:
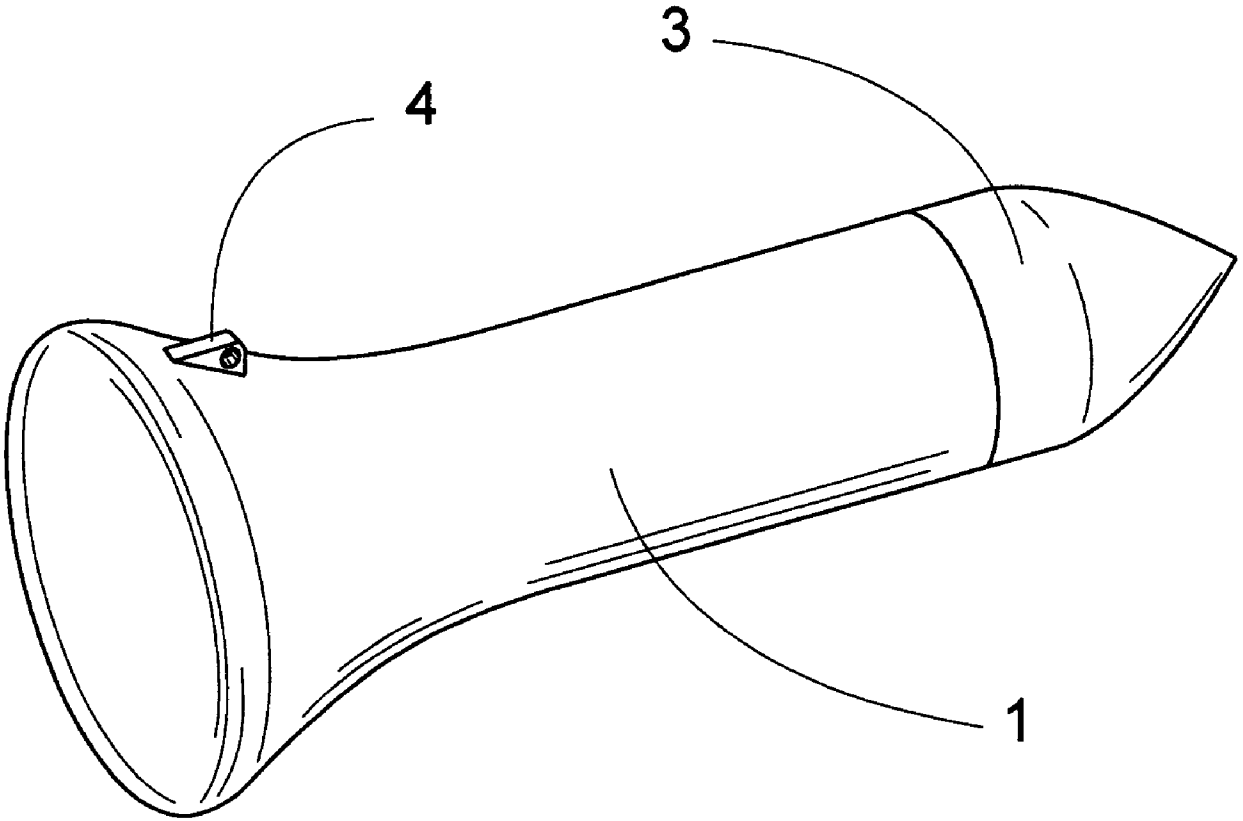
FIG. 1 is an assembled perspective view of a portable, attachable holder in accordance with the invention.

FIG. 1 is an assembled perspective view of a portable, attachable holder in accordance with the invention. An envelope 1 is made of plastic, metal, wood or other suitable materials. The envelope 1 is made of one piece or several pieces. The envelope 1 size, shape and/or design is befitting a particular application or disguise. In this embodiment the envelope 1 is designed resembling an oversized golf tee disguising its intended purpose when in public view among golfers. A sealing device or system 3 closes the envelope 1. The sealing device or system 3 is mechanical, adhesive or other suitable systems. The sealing device or system 3 can be made from or incorporate the envelope 1 or parts of the envelope 1. The sealing device or system 3 can be made from one or more piece or pieces. The sealing device or system 3 can be made of plastic, metal, wood or other suitable materials. In this embodiment the sealing device or system 3 is designed resembling the pointed end of a golf tee. An attaching device 4 is made of plastic, metal, wood or other suitable materials. The attaching device 4 size, shape and/or design is befitting a particular application or disguise. In this embodiment the attaching device 4 is a protrusion with a hole passing thru. Commonly present or available objects such as belts, key chains, ropes, strings, carabiners or others could be passed thru the hole in the protrusion to facilitate fastening the holder to another object or objects, such as a golf bag or golf cart for this embodiment.

Figure 2:
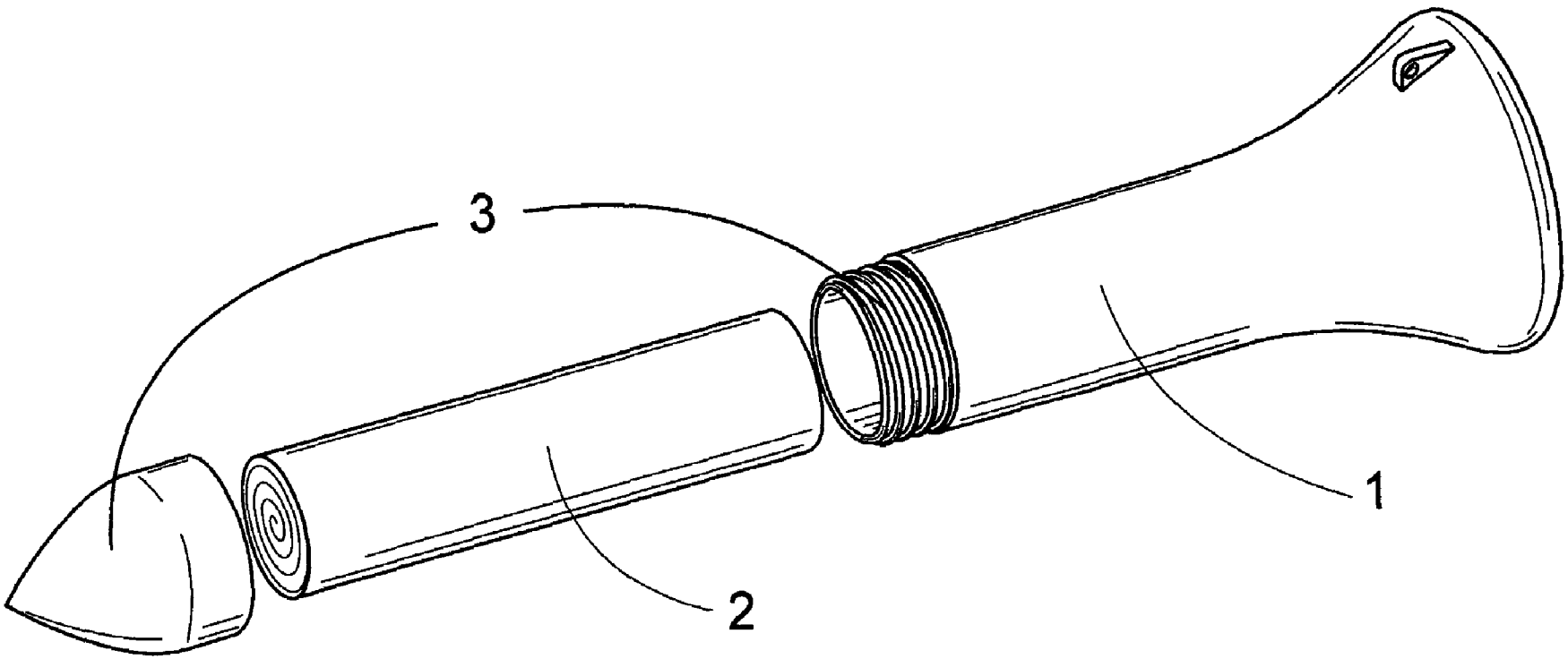
FIG. 2 is an exploded perspective view of a portable, attachable holder containing one auxiliary or emergency toilet tissue roll in accordance with the invention.

FIG. 2 is an exploded perspective view of a portable, attachable holder containing one auxiliary or emergency toilet tissue roll 2 in accordance with the invention. The tissue roll 2 is enclosed within the envelope 1 and the sealing device or system 3. In this embodiment the envelope 1 and the sealing device or system 3 are affixed by mechanical threads.

Figure 3:
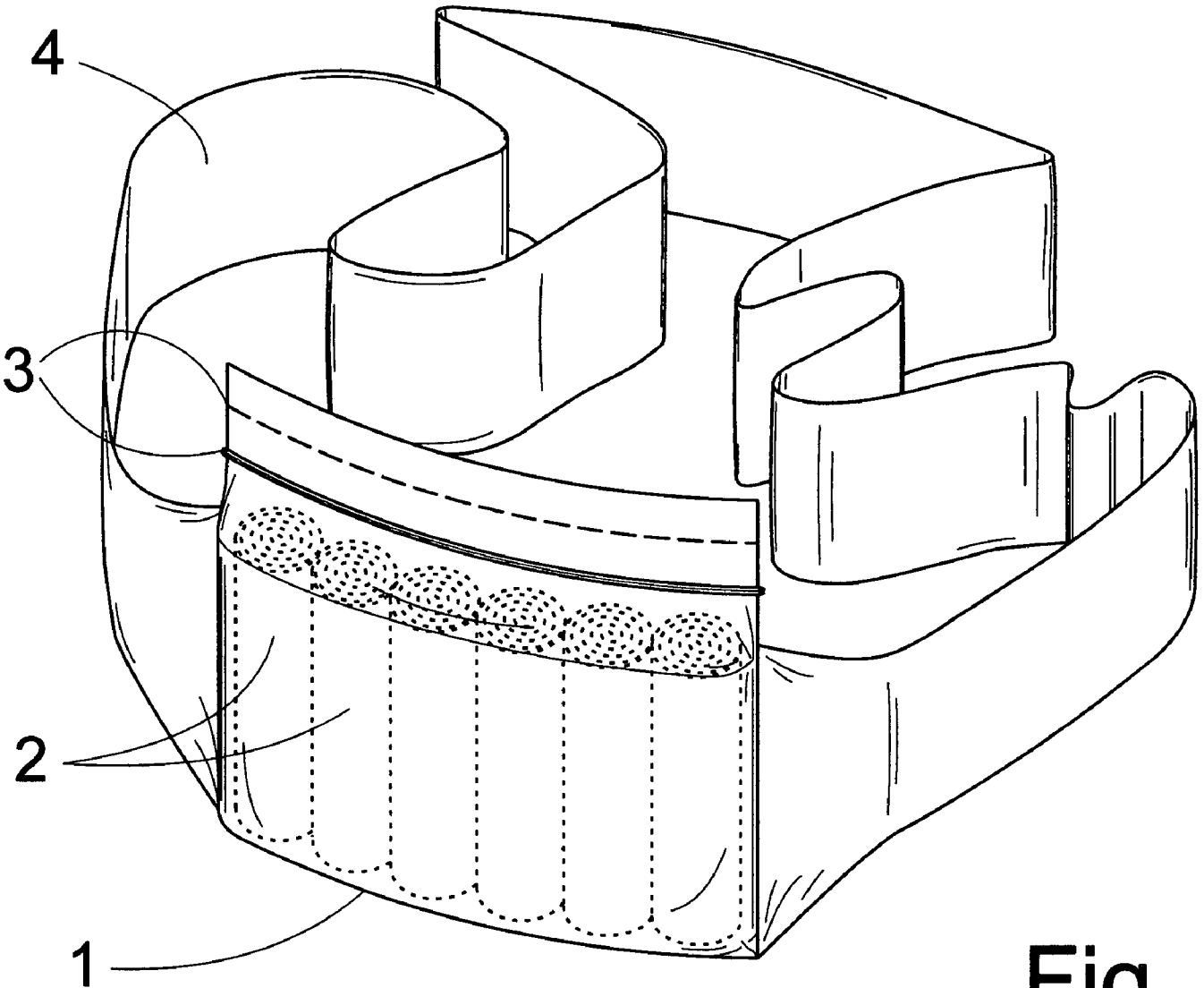
FIG. 3 is an assembled perspective view of a portable, attachable holder containing more than one auxiliary or emergency toilet tissue roll in accordance with the invention.

FIG. 3 is a assembled perspective view of a portable, attachable holder containing more than one auxiliary or emergency toilet tissue roll 2 in accordance with the invention. In this embodiment the envelope 1 is a translucent plastic pouch of simple design where a need for quantity negates any need for disguise, such as would be in a crisis or emergency situation. This embodiment manifests two sealing devices or systems. The inner sealing device or system 3 is an interlocking, press-to-close/pull-to-open mechanism common to resealable plastic bags. The outer sealing device or system 3 is a heat-sealed weld closing the plastic envelope 1 to be opened by tearing along a perforation. In this embodiment the attaching device 4 is a sash for draping, hooking, tying or looping the holder onto any other convenient or available object or objects.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A portable, attachable, auxiliary toilet tissue roll holder, comprising:

an envelope for containing and protecting an auxiliary or emergency toilet tissue roll or rolls;

auxiliary or emergency toilet tissue, inserted to said envelope for containing and protecting the auxiliary or emergency toilet tissue roll or rolls;

means for hermetically enclosing and protecting the auxiliary or emergency toilet tissue from moisture within the envelope, affixed to said envelope for containing and protecting the auxiliary or emergency toilet tissue roll or rolls; and means for securing the envelope to another object affixed to said envelope for containing and protecting the auxiliary or emergency toilet tissue roll or rolls;

wherein the auxiliary toilet tissue roll holder is configured as an oversized golf tee.

2. The portable, attachable, auxiliary toilet tissue roll holder in accordance with claim 1, wherein said envelope for containing and protecting the auxiliary or emergency toilet tissue roll or rolls comprises a hollow or open envelope.

3. The portable, attachable, auxiliary toilet tissue roll holder in accordance with claim 1, wherein said auxiliary or emergency toilet tissue comprises a wound tissue roll.

4. The portable, attachable, auxiliary toilet tissue roll holder in accordance with claim 1, wherein said means for hermetically enclosing and protecting the auxiliary or emergency toilet tissue within the envelope comprises a threaded or push-to-close sealing device or system.

5. The portable, attachable, auxiliary toilet tissue roll holder in accordance with claim 1, wherein said means for securing the envelope to another object comprises an attaching device.

6. A portable, attachable, auxiliary toilet tissue roll holder, comprising:

a hollow or open envelope, for containing and protecting an auxiliary or emergency toilet tissue roll or rolls;

a wound tissue roll or rolls, for auxiliary or emergency toilet tissue, inserted into said envelope;

a sealing device or system, for hermetically enclosing and protecting from moisture the wound tissue roll or rolls within the envelope, affixed to said hollow or open envelope; and an attaching device, for securing the envelope to another object, affixed to said hollow or open envelope;

wherein the auxiliary toilet tissue roll holder is configured as an oversized golf tee.

* * * * *